US011299329B2

(12) United States Patent
Sakata

(10) Patent No.: US 11,299,329 B2
(45) Date of Patent: Apr. 12, 2022

(54) APPLICATION CONTAINER

(71) Applicant: Sato Pharmaceutical Co., Ltd., Tokyo (JP)

(72) Inventor: Kota Sakata, Tokyo (JP)

(73) Assignee: Sato Pharmaceutical Co., Ltd., Tokyo (JP)

( * ) Notice: Subject to any disclaimer, the term of this patent is extended or adjusted under 35 U.S.C. 154(b) by 0 days.

(21) Appl. No.: 17/058,798

(22) PCT Filed: May 27, 2019

(86) PCT No.: PCT/JP2019/020799
§ 371 (c)(1),
(2) Date: Nov. 25, 2020

(87) PCT Pub. No.: WO2019/230619
PCT Pub. Date: Dec. 5, 2019

(65) Prior Publication Data

US 2021/0206543 A1 Jul. 8, 2021

(30) Foreign Application Priority Data

May 31, 2018 (JP) ..... JP2018-105125
Jul. 19, 2018 (JP) ..... JP2018-135943

(51) Int. Cl.
*A45D 34/04* (2006.01)
*B65D 47/42* (2006.01)
(Continued)

(52) U.S. Cl.
CPC ..... *B65D 47/42* (2013.01); *A45D 34/04* (2013.01); *A45D 2200/054* (2013.01);
(Continued)

(58) Field of Classification Search
CPC ..... A45D 34/04; A45D 2200/054; A45D 2200/1036; A45D 2200/05;
(Continued)

(56) References Cited

U.S. PATENT DOCUMENTS 4,960,340 A * 10/1990 Tamiya ..... A45D 34/042 401/186
5,678,942 A * 10/1997 Kobayashi ..... B43K 1/086 401/205
7,425,102 B1 9/2008 Velliquette

FOREIGN PATENT DOCUMENTS

JP S63111453 U 7/1988
JP S63160987 U 10/1988
(Continued)

OTHER PUBLICATIONS

PCT Office, International Search Report issued in PCT/JP2019/020799 dated Jul. 23, 2019.
(Continued)

*Primary Examiner* — David J Walczak
(74) *Attorney, Agent, or Firm* — Wood Herron & Evans LLP

(57) ABSTRACT

An application container (1) includes a container main body (2); an inner plug member (20); and an impregnation material (30). The inner plug member (20) includes an impregnation material accommodating portion (21), and a valve body accommodating portion (22) which includes a valve seat (22*a*) on an impregnation material accommodating portion (21) side and a valve body support portion (22*b*) on a container main body (2) side and in which a valve body (22*c*) is disposed so as to be movable between the valve seat (22*a*) and the valve body support portion (22*b*). A communication groove (50) which forms a gap between the valve body (22*c*) and the valve body accommodating portion (22)
(Continued)

in a state where the valve body (22*c*) is supported by the valve body support portion (22*b*) is formed.

3 Claims, 5 Drawing Sheets

(51) Int. Cl.
*B43K 1/00* (2006.01)
*B43K 5/18* (2006.01)

(52) U.S. Cl.
CPC ..... *A45D 2200/1009* (2013.01); *A45D 2200/1036* (2013.01); *B43K 1/006* (2013.01); *B43K 5/1827* (2013.01)

(58) Field of Classification Search
CPC ..... A45D 2200/1009; A45D 40/26; B65D 47/42; B65D 47/00; B43K 1/003; B43K 1/006; B43K 5/18; B43K 5/1818; B43K 5/1827
USPC ..... 401/198, 199, 205, 224
See application file for complete search history.

(56) References Cited

FOREIGN PATENT DOCUMENTS

| | | | |
|---|---|---|---|
| JP | H03240656 | A | 10/1991 |
| JP | H0577047 | U | 10/1993 |
| JP | H06055127 | A | 3/1994 |
| JP | 2005306403 | A | 11/2005 |
| JP | 2014193740 | A | 10/2014 |
| JP | 2015006235 | A | 1/2015 |
| JP | 2016155571 | A | 9/2016 |
| JP | 2017043397 | A | 3/2017 |
| JP | 2018034859 | A | 3/2018 |
| KR | 100566823 | B1 | 4/2006 |

OTHER PUBLICATIONS

Japanese Patent Office, Office Action issued in JP 2018-135943 dated Dec. 3, 2019.
European Patent Office, Search Report issued in EP 19812624.5 dated Feb. 23, 2022.

* cited by examiner

APPLICATION CONTAINER

TECHNICAL FIELD

The present invention relates to an application container. Priority is claimed on Japanese Patent Application No. 2018-105125, filed May 31, 2018 and Japanese Patent Application No. 2018-135943, filed Jul. 19, 2018, the contents of which are incorporated herein by reference.

BACKGROUND ART

In the related art, there has been known an application container that applies a content liquid such as a drug solution to a site to be applied such as the scalp or skin of the human body. This type of application container includes an application plug as shown in, for example, Patent Document 1 below. The application plug includes an inner plug member that has a cylindrical shape, is mounted on a mouth portion of a container main body, and is provided with a communication hole which communicates with the inside of the container main body and a discharge hole which communicates with the communication hole and discharges the content liquid; an application member (impregnation material) that is disposed inside the inner plug member so as to be movable toward a communication hole side in a state where a tip portion of the application member protrudes outside from the discharge hole; and a biasing member that biases the application member toward a discharge hole side. A valve seat with which a valve body formed in the application member detachably comes into contact from the communication hole side is formed in a portion of the inner plug member between the communication hole and the discharge hole. Therefore, according to the application container, in a standby state, the valve is closed to be able to restrict the content liquid from moving from inside the container main body to an impregnation material side, and when the impregnation material is pushed toward the inside of the container main body, the valve is opened to be able to allow the content liquid from moving from inside the container main body to the impregnation material side.

CITATION LIST

Patent Document

Patent Document 1

Japanese Unexamined Patent Application, First Publication No. 2018-34859

SUMMARY OF INVENTION

Technical Problem

By the way, in the application container of the related art, in a standby state, the valve is closed. Therefore, for example, when the temperature of the hand is transferred to the container main body, the internal pressure of the container main body rises. In this state, when the impregnation material is pushed toward the inside of the container main body to open the valve, there is a possibility that the pressure of the container main body is released to cause the content liquid to strongly spout out, and the content liquid is excessively applied to a site to be applied.

The present invention has been made in view of the above circumstances, and an object of the present invention is to provide an application container that can apply an appropriate amount of a content liquid to a site to be applied and has good ease of use.

Solution to Problem (1) According to a first aspect of the present invention, there is provided an application container including: a container main body that accommodates a content liquid; an inner plug member that has a cylindrical shape and is mounted on a mouth portion of the container main body; and an impregnation material that is fitted inside the inner plug member and is impregnable with the content liquid. The inner plug member includes: an impregnation material accommodating portion that accommodates the impregnation material in a state where a tip portion of the impregnation material protrudes; and a valve body accommodating portion which communicates with the impregnation material accommodating portion and includes a valve seat on an impregnation material accommodating portion side and a valve body support portion on a container main body side, and in which a valve body is disposed so as to be movable between the valve seat and the valve body support portion. A communication groove which forms a gap between the valve body and the valve body accommodating portion in a state where the valve body is supported by the valve body support portion, and which allows the container main body and an outside to communicate with each other via the valve body accommodating portion and the impregnation material accommodating portion is formed.

According to the first aspect of the present invention, in an upright state where the container main body is located on a lower side and the impregnation material is located on the upper side, the valve body is supported by the valve body support portion, and the container main body and the outside communicate with each other through the communication groove that forms the gap between the valve body and the valve body accommodating portion, and thus the pressure of the container main body is released. For this reason, when the application container is used, there occurs no spouting of the content liquid caused by a pressure difference between inside and outside the container main body. In addition, when the state of the application container is changed from an upright state to an inverted state and then the application container is used, a certain amount of the content liquid in the valve body accommodating portion is pushed out to the impregnation material accommodating portion by upward and downward movement of the valve body. Then, when the valve body comes into contact with the valve seat, since the supply of the content liquid from the valve body accommodating portion to the impregnation material is restricted, the impregnation material is not excessively impregnated, and the occurrence of dripping can be prevented.

(2) According to a second aspect of the present invention, in the first aspect, the valve seat may be provided with a content liquid supply groove that supplies the content liquid from the valve body accommodating portion to the impregnation material in a state where the valve seat is in contact with the valve body.

According to the second aspect of the present invention, even when the container main body is in an inverted state and the valve body is in contact with the valve seat, the content liquid can be supplied from the valve body accommodating portion to the impregnation material. For this reason, even when it is difficult for the content liquid to come out during use of the application container, it is possible to reduce the number of execution times of an operation such as brining the application container into an upright state once and then into an inverted state to cause the impregnation material to be again impregnated with the content liquid.

(3) According to a third aspect of the present invention, in the first or second aspect, the valve body accommodating portion may have a peripheral wall that connects the valve seat and the valve body support portion. The valve body may be formed in a non-spherical shape, and have a guide surface that is guided by the peripheral wall of the valve body accommodating portion. The communication groove may be formed in the guide surface of the valve body.

According to the third aspect of the present invention, when the container main body is in an upright state, since the container main body and the outside communicate with each other through the communication groove formed in the valve body, the pressure of the container main body is released. For this reason, when the application container is used, there occurs no spouting of the content liquid caused by a pressure difference between inside and outside the container main body. In addition, the valve body has a non-spherical shape, and has a guide surface that is guided by the peripheral wall of the valve body accommodating portion. For this reason, even when the valve body moves upward and downward, the posture of the valve body is maintained in a certain posture, and the pressure of the container main body is reliably released via the communication groove formed in the valve body.

Advantageous Effects of Invention

According to the present invention, an appropriate amount of the content liquid can be applied to a site to be applied, and the application container having good ease of use can be obtained.

DESCRIPTION OF EMBODIMENTS

Hereinafter, an application container according to one embodiment of the present invention will be described with reference to the drawings.

First Embodiment

Figure 1:
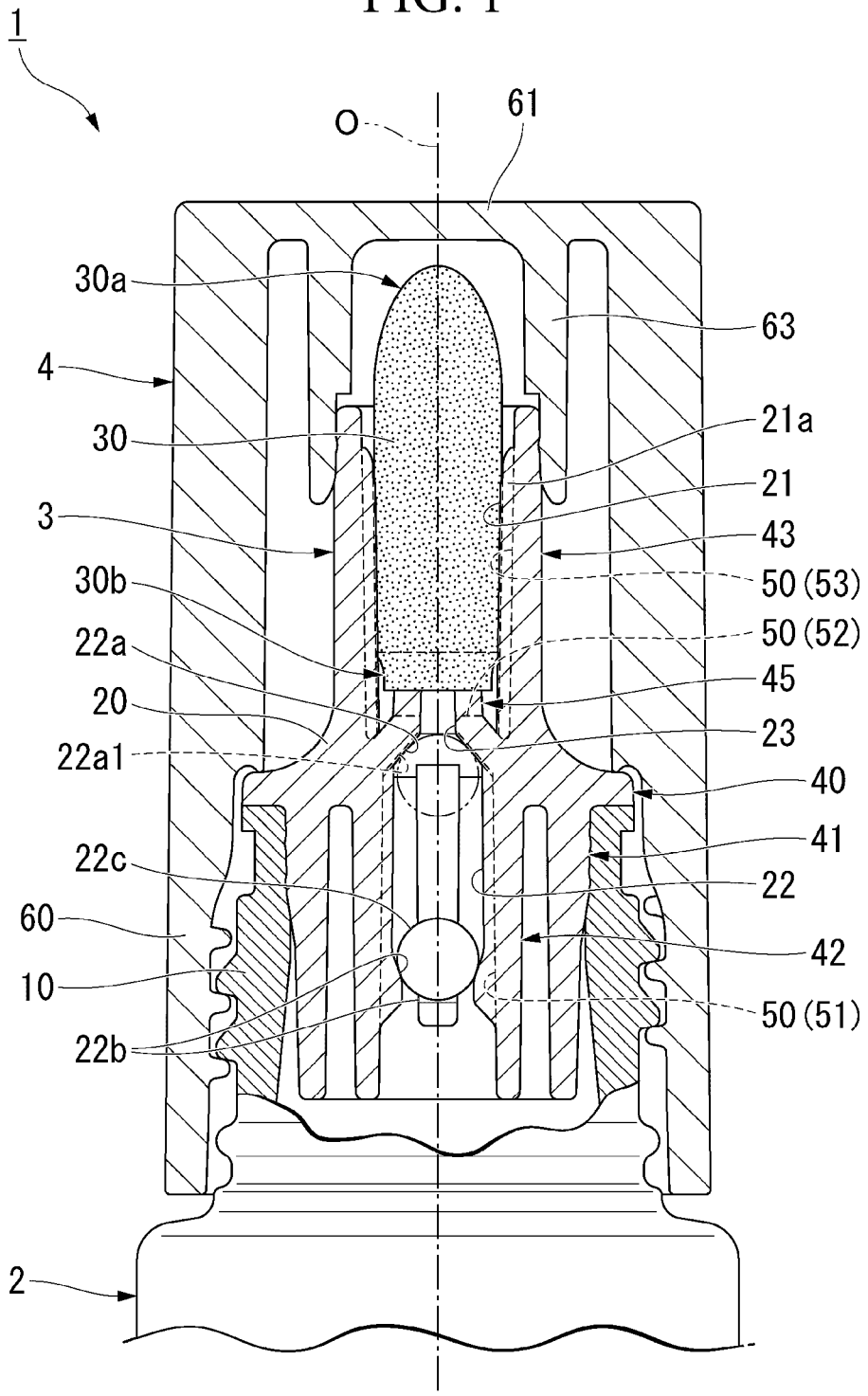
FIG. 1 is a longitudinal cross-sectional view of an application container according to a first embodiment of the present invention.

As shown in FIG. 1, an application container 1 according to the present embodiment includes a container main body 2 that has a bottomed cylindrical shape and accommodates a content liquid to be applied to a site to be applied, an application plug 3 that has a cylindrical shape and is mounted inside a mouth portion 10 of the container main body 2, and an overcap 4 that has a topped cylindrical shape and is detachably mounted on the mouth portion 10 of the container main body 2 to cover the application plug 3. Incidentally, the content liquid is not particularly limited, and examples of the content liquid include a hair restorer, a medicine such as an athlete's foot medicine, and liquid such as cosmetics which are to be applied to a site, such as the human body or the skin.

In FIG. 1, the central axes of the container main body 2, the application plug 3, and the overcap 4 are disposed on a common axis. In the present embodiment, the common axis is referred to as a container axis O, and an overcap 4 side and a side opposite the overcap 4 side (container main body 2 side) along a container axis O direction are referred to as an upper side and a lower side, respectively. Incidentally, the container axis O direction may be referred to as an upward and downward direction, and in the container axis O direction, a direction from a bottom portion to be described later of the container main body 2 toward a cap top wall 61 to be described later of the overcap 4 may be referred to as an upper side and a direction opposite the above direction may be referred to as a lower side. Namely, a direction from the bottom portion of the container main body 2 toward an upper end portion 30*a* (tip portion) to be described later of an impregnation material 30 and a direction opposite the above direction may be also referred to as an upper side and a lower side, respectively. In addition, in a plan view seen in the container axis O, a direction intersecting the container axis O is referred to as a radial direction and a direction around the container axis O is referred to as a circumferential direction.

The mouth portion 10 of the container main body 2 has a smaller diameter than portions (shoulder portion, body portion, and bottom portion) of the container main body 2 other than the mouth portion 10. In the shown example, a male screw to which the overcap 4 can be screwed is formed in an outer peripheral surface of the mouth portion 10 of the container main body 2. The overcap 4 is formed in a topped cylindrical shape including a cap cylinder 60 that encloses the mouth portion 10 of the container main body 2 and the application plug 3 from outside in the radial direction, and the cap top wall 61 that closes an upper end opening portion of the cap cylinder 60.

A female screw to be screwed to the male screw of the mouth portion 10 of the container main body 2 is formed in an inner peripheral surface of a portion of the cap cylinder 60, the portion surrounding the mouth portion 10 of the container main body 2. Accordingly, the overcap 4 is detachably mounted on the mouth portion 10 of the container main body 2. Incidentally, a method for mounting the overcap 4 is not limited to screwing, and for example, the overcap 4 may be mounted on the mouth portion 10 of the container main body 2 by undercut fitting.

The cap top wall 61 is provided with a support cylindrical portion 63 that extends downward to be detachably fitted to an outer peripheral surface of a second cylindrical portion 43 to be described later of the application plug 3. Accordingly, the overcap 4 can be rotated around the container axis O in a state where the support cylindrical portion 63 is fitted to the second cylindrical portion 43, and thus a mounting operation and a removal operation of the overcap 4 with respect to the mouth portion 10 of the container main body 2 are stably performed.

The application plug 3 includes an inner plug member 20 that has a cylindrical shape and is mounted on the mouth portion 10 of the container main body 2, and the impregnation material 30 that is fitted inside the inner plug member 20 and can be impregnated with the content liquid. Examples of the impregnation material 30 include a porous material such as a sponge, a fiber material in which synthetic fibers are solidified by a resin solution and which can be impregnated with the content liquid by the capillary phenomenon, and the like. However, the impregnation material 30 is not limited to these materials, and may be any one as long as the impregnation material 30 can be impregnated with the content liquid.

When the above-described fiber material is adopted as the impregnation material 30, for example, bundled synthetic fibers may be solidified by using a resin solution in a state where a plurality of synthetic fibers (for example, polyester fibers, nylon fibers, acrylic fibers, or the like) having, for example, a fiber diameter of several μ to several tens of μ are bundled. In this case, the density of the synthetic fibers may be adjusted such that the porosity (cubage ratio or volume ratio between the synthetic fibers which are a solid portion and pores (voids)) is within, for example, a range of approximately 40% to 80%. Accordingly, the impregnation of the content liquid can be appropriately performed by the capillary phenomenon. Incidentally, for example, a solution of polyurethane resin can be used as the above resin solution.

The impregnation material 30 is formed in a substantially columnar shape disposed coaxially with the container axis O. The upper end portion 30*a* (tip portion) of the impregnation material 30 protrudes upward from the inner plug member 20. The upper end portion 30*a* of the impregnation material 30 is formed in a semi-elliptical sphere shape. Incidentally, the shape of the upper end portion 30*a* of the impregnation material 30 is not limited to this shape, and may be appropriately changed according to a site to be applied. Meanwhile, a lower end portion 30*b* of the impregnation material 30 is disposed inside the inner plug member 20. The lower end portion 30*b* of the impregnation material 30 is gradually reduced in diameter as the lower end portion 30*b* extends downward.

The inner plug member 20 includes a flange portion 40 having an annular shape, a fitting cylindrical portion 41 having a cylindrical shape, a first cylindrical portion 42 having a topped cylindrical shape, and the second cylindrical portion 43 having a bottomed cylindrical shape. The flange portion 40, the fitting cylindrical portion 41, the first cylindrical portion 42, and the second cylindrical portion 43 are disposed coaxially with the container axis O as a common axis. The flange portion 40 is disposed at an upper end opening edge of the mouth portion 10 of the container main body 2 to extend inward from the upper end opening edge in the radial direction. The fitting cylindrical portion 41 extends downward from the flange portion 40, and an outer peripheral surface of the fitting cylindrical portion 41 is fitted to an inner peripheral surface of the mouth portion 10.

The first cylindrical portion 42 is disposed inside the fitting cylindrical portion 41 in the radial direction to extend downward from the flange portion 40. The second cylindrical portion 43 is disposed inside the fitting cylindrical portion 41 in the radial direction to extend upward from the flange portion 40. A bottom portion of the second cylindrical portion 43 is formed integrally with a top portion of the first cylindrical portion 42, and the outer diameter of the second cylindrical portion 43 is smaller than the inner diameter of the fitting cylindrical portion 41 and is larger than the outer diameter of the first cylindrical portion 42. The first cylindrical portion 42 having a topped cylindrical shape and the second cylindrical portion 43 having a bottomed cylindrical shape communicate with each other through a communication hole 23 formed coaxially with the container axis O.

The second cylindrical portion 43 forms an impregnation material accommodating portion 21 that accommodates the impregnation material 30 in a state where the upper end portion 30*a* protrudes. The impregnation material accommodating portion 21 has a length such that approximately ⅔ of the total length of the impregnation material 30 can be accommodated. Namely, the impregnation material accommodating portion 21 can accommodate a portion of the impregnation material 30, the portion corresponding to approximately ⅔ of the total length of the impregnation material 30 in the container axis O direction. A plurality of fitting ribs 21*a* are formed in the impregnation material accommodating portion 21. The plurality of fitting ribs 21*a* extend in an axial direction along an inner peripheral surface of the second cylindrical portion 43, and are disposed at intervals in the circumferential direction. The impregnation material 30 is fitted inside the impregnation material accommodating portion 21 in a state where an outer peripheral surface of the impregnation material 30 is slightly deformed inward in the radial direction by the plurality of fitting ribs 21*a*.

A lower end surface of the impregnation material 30 is supported by a plurality of support ribs 45 that protrude from the bottom portion of the second cylindrical portion 43. The plurality of support ribs 45 are formed in the bottom portion of the second cylindrical portion 43 at intervals in the circumferential direction along an opening edge of the communication hole 23. The first cylindrical portion 42 includes a valve seat 22*a* on an impregnation material accommodating portion 21 side and a valve body support portion 22*b* on a container main body 2 side, and forms a valve body accommodating portion 22 in which a valve body 22*c* is disposed so as to be movable between the valve seat 22*a* and the valve body support portion 22*b* due to the own weight of the valve body 22*c*. Namely, the valve seat 22*a* is formed in a portion of the first cylindrical portion 42, which is close to the impregnation material accommodating portion 21, and the valve body support portion 22*b* is formed in a portion of the first cylindrical portion 42, which is close the container main body 2. The valve body accommodating portion 22 is formed between the valve seat 22*a* and the valve body support portion 22*b* of the first cylindrical portion 42, and the valve body 22*c* is disposed in the valve body accommodating portion 22 between the valve seat 22*a* and the valve body support portion 22*b* so as to be movable due to the own weight.

The valve seat 22*a* is formed in a peripheral edge portion of the communication hole 23 in the top portion of the first cylindrical portion 42. The valve seat 22*a* is formed coaxially with the communication hole 23, and is formed in a tapered shape that is reduced in diameter as the valve seat 22*a* extends upward. The maximum diameter of the valve seat 22*a* is larger than the outer diameter of the valve body 22*c*. In addition, the minimum diameter of the valve seat 22*a* is smaller than the outer diameter of the valve body 22*c*. As a result, the valve body 22*c* can be seated over the entire perimeter of the valve seat 22*a*.

The valve body support portion 22*b* prevents the valve body 22*c* from falling from a bottom portion opening (namely, an opening provided in a bottom portion) of the first cylindrical portion 42 to the container main body 2 side. In addition, the valve body support portion 22*b* guides upward and downward movement of the valve body 22*c* in the valve body accommodating portion 22. The valve body support portion 22*b* is formed in a rib shape that extends from the top portion of the first cylindrical portion 42 to a lower side of the container axis O direction along an inner peripheral surface of the first cylindrical portion 42. A plurality of the valve body support portions 22*b* are formed at intervals in the circumferential direction of the inner peripheral surface of the first cylindrical portion 42. Lower end portions of the valve body support portions 22*b* protrude inward in the radial direction.

The diameter of an imaginary circle formed at radial inner end edges of the lower end portions of the plurality of valve body support portions 22*b* is smaller than the outer diameter of the valve body 22*c*. As a result, the valve body 22*c* is supported by the lower end portions of the plurality of valve body support portions 22*b*. The valve body 22*c* is a steel ball having a larger specific gravity than that of the content liquid. Incidentally, the valve body 22*c* may be a resin ball as long as the specific gravity of the resin ball is larger than that of the content liquid. In addition, the valve body support portions 22*b* may be formed of only the lower end portions thereof. Namely, the valve body support portions 22*b* may not extend in a rib shape from the top portion of the first cylindrical portion 42 to the lower side of the container axis O direction. In this case, the outer diameter of the valve body 22*c* may be smaller than the inner diameter of the valve body accommodating portion 22. The inner plug member 20 with the above configuration is provided with a communication groove 50 that allows the container main body 2 and the outside to communicate with each other via the valve body accommodating portion 22 and the impregnation material accommodating portion 21 in a state where the valve body 22*c* is supported by the valve body support portions 22*b*.

The communication groove 50 includes a first communication groove 51, a second communication groove 52, and a third communication groove 53. The first communication groove 51 is formed in the valve body accommodating portion 22 of the first cylindrical portion 42. The first communication groove 51 is formed of gaps between the valve body support portions 22*b* described above which have a rib shape and which are adjacent to each other in the circumferential direction. Namely, a plurality of the first communication grooves 51 are formed at intervals in the circumferential direction along the inner peripheral surface of the first cylindrical portion 42, and each of the first communication grooves 51 extends toward the top portion of the first cylindrical portion 42 in the axial direction.

The second communication groove 52 and the third communication groove 53 are formed in the impregnation material accommodating portion 21 of the second cylindrical portion 43. The second communication groove 52 is formed of gaps between the support ribs 45 described above which are adjacent to each other in the circumferential direction. Namely, the second communication grooves 52 are formed in the bottom portion of the second cylindrical portion 43 at intervals in the circumferential direction and radially with respect to the communication hole 23. The third communication groove 53 is formed of gaps between the fitting ribs 21*a* described above which are adjacent to each other in the circumferential direction. Namely, a plurality of the third communication grooves 53 are formed at intervals in the circumferential direction along the inner peripheral surface of the second cylindrical portion 43, and each of the third communication grooves 53 extends toward a top portion opening (namely, an opening provided in a top portion) of the second cylindrical portion 43 in the axial direction.

In addition, the valve seat 22*a* of the present embodiment is provided with a content liquid supply groove 22*a*1 that supplies the content liquid from the valve body accommodating portion 22 to the impregnation material 30 in a state where the valve seat 22*a* is in contact with the valve body 22*c*. The content liquid supply groove 22*a*1 is sufficiently smaller than the communication groove 50 described above. The content liquid supply groove 22*a*1 is radially formed so as to cross in the radial direction a seal surface of the valve seat 22*a* with which the valve body 22*c* comes into contact in an annular shape. The content liquid supply groove 22*a*1 can supply a very small amount of the content liquid from the valve body accommodating portion 22 to the impregnation material 30 even when the valve body 22*c* is in contact with the valve seat 22*a*.

Next, a case where the application container 1 configured as described above is used to apply the content liquid to a site to be applied will be described.

When the content liquid is applied, first, the overcap 4 is removed from the mouth portion 10 of the container main body 2. For example, when a volatile content liquid (athlete's foot medicine or the like) is accommodated in the container main body 2, the heat of the hand is transferred to the container main body 2, so that the internal pressure of the container main body 2 is likely to rise. However, as shown in FIG. 1, namely, in an upright state where the container main body 2 is located on the lower side and the impregnation material 30 is located on the upper side, the valve body 22*c* is supported by the valve body support portions 22*b*, and the container main body 2 and the outside communicate with each other through the communication groove 50 provided in the inner plug member 20. Incidentally, the upright state means a state where the application container 1 takes a posture in which the container main body 2 is located below the impregnation material 30 in a vertical direction and the impregnation material 30 is located above the container main body 2 in the vertical direction, and includes a state where the application container 1 takes a posture in which the tip portion of the impregnation material 30 is oriented toward a direction which is obliquely upward with respect to the vertical direction.

Namely, gas pressurized inside the container main body 2 enters the valve body accommodating portion 22 from the bottom portion opening of the first cylindrical portion 42 to pass through the first communication grooves 51 formed of the gaps between the valve body support portions 22*b* in the axial direction, and then to enter the impregnation material accommodating portion 21 via the communication hole 23. After the gas which has entered the impregnation material accommodating portion 21 passes through the second communication grooves 52 formed of the gaps between the support ribs 45 in the radial direction, the gas passes through the third communication grooves 53 formed of the gaps between the fitting ribs 21*a* in the axial direction to escape from the top portion opening of the second cylindrical portion 43 to the outside. For this reason, when the overcap 4 is removed from the container main body 2, at the same time, the pressure of the container main body 2 is released, so that there occurs no pressure difference between inside and outside the container main body 2.

Figure 2:
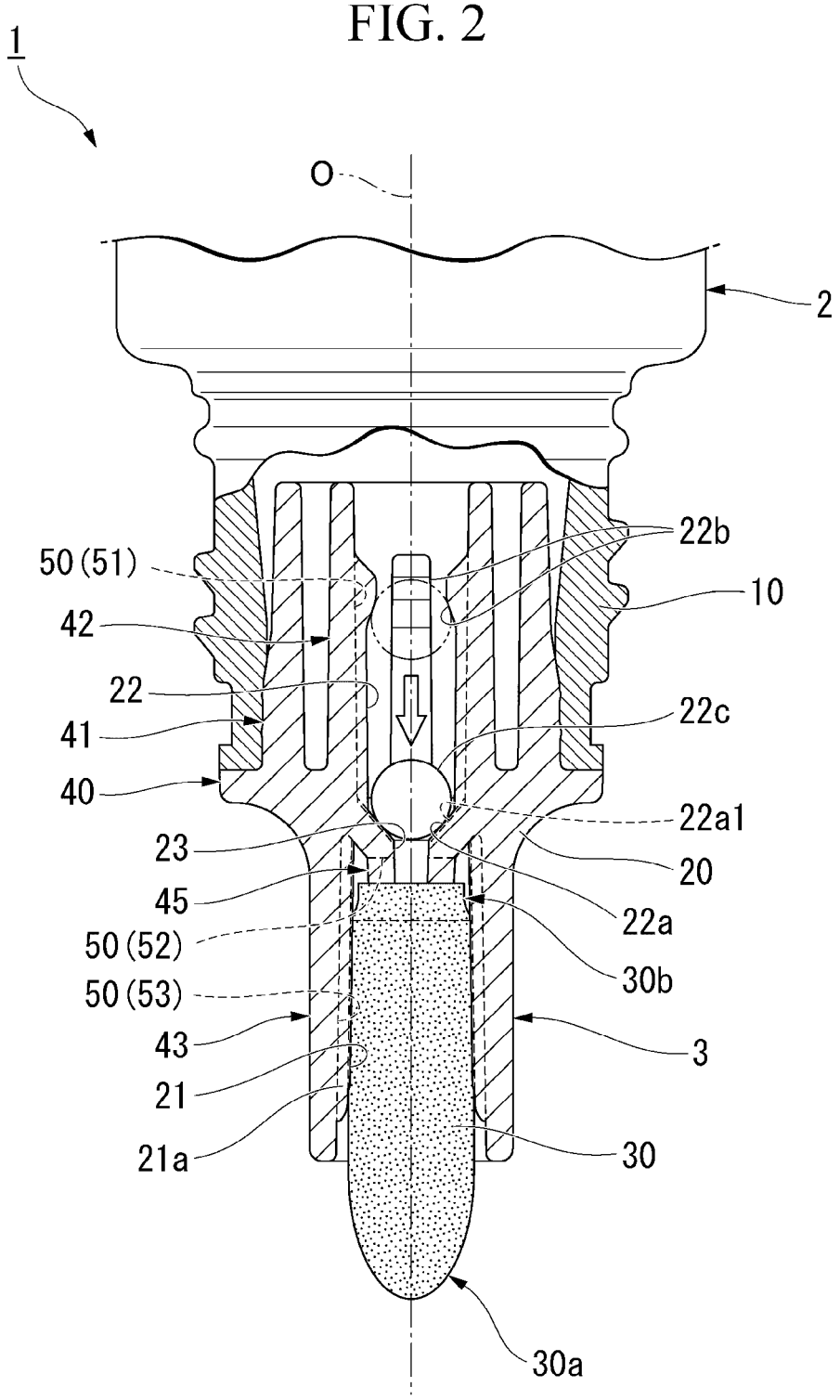
FIG. 2 is a view showing an example of use of the application container, in which an overcap is removed from the application container shown in FIG. 1 and then the application container is brought into an inverted state.

When the application container 1 is used, as shown in FIG. 2, the application container 1 is brought into an inverted state where the container main body 2 is located on the upper side and the impregnation material 30 is located on the lower side. Incidentally, the inverted state includes an inclined posture where the impregnation material 30 faces obliquely downward. For a more detail description, the inverted state means a state where the application container 1 takes a posture in which the container main body 2 is located above the impregnation material 30 in the vertical direction and the impregnation material 30 is located below the container main body 2 in the vertical direction, and includes a state where the application container 1 takes a posture in which the tip portion of the impregnation material 30 is oriented toward a direction which is obliquely downward with respect to the vertical direction.

In the inverted state, due to the own weight of the valve body 22*c*, the valve body 22*c* separates from the lower end portions of the valve body support portions 22*b* to move toward the valve seat 22*a*. Due to the movement of the valve body 22*c*, the content liquid in the valve body accommodating portion 22 is pushed out to the impregnation material accommodating portion 21 to be impregnated into the impregnation material 30. Then, when the valve body 22*c* comes into contact with the valve seat 22*a*, the supply of the content liquid from the valve body accommodating portion 22 to the impregnation material 30 is restricted. Namely, a certain amount of the content liquid is supplied to the impregnation material 30 by the upward and downward movement of the valve body 22*c*. In this state, the impregnation material 30 is pressed against the site to be applied, so that an appropriate amount of the content liquid can be applied to the site to be applied. Incidentally, the container main body 2 on which the overcap 4 is mounted may be brought into an inverted state and then be shaken to cause the impregnation material 30 to be impregnated with the content liquid in advance.

When it is difficult for the content liquid to come out during use of the application container 1, the container main body 2 is again brought into an upright state and then into an inverted state to be used, so that the impregnation material 30 can be again impregnated with the content liquid. Here, in the present embodiment, the content liquid supply groove 22*a*1 is formed in the valve seat 22*a*. The content liquid supply groove 22*a*1 can supply a very small amount of the content liquid from the valve body accommodating portion 22 to the impregnation material 30 even when the valve body 22*c* is in contact with the valve seat 22*a*. For this reason, even when it is difficult for the content liquid to come out during use of the application container 1, it is possible to reduce the number of execution times of the above-described operation such as brining the container main body 2 into an upright state and then into an inverted state to cause the impregnation material 30 to be again impregnated with the content liquid.

As described above, in an upright state where the container main body 2 is located on the lower side and the impregnation material 30 is located on the upper side, the valve body 22*c* is supported by the valve body support portions 22*b*, and the container main body 2 and the outside communicate with each other through the communication groove 50 provided in the inner plug member 20, and thus the internal pressure of the container main body 2 is released. For this reason, when the application container 1 is used, there occurs no spouting of the content liquid caused by a pressure difference between inside and outside the container main body 2. In addition, when the state of the container main body 2 is changed from an upright state to an inverted state, a certain amount of the content liquid in the valve body accommodating portion 22 is pushed out to the impregnation material accommodating portion 21 by the upward and downward movement of the valve body 22*c*. Then, when the valve body 22*c* comes into contact with the valve seat 22*a*, since the supply of the content liquid from the valve body accommodating portion 22 to the impregnation material 30 is restricted, the impregnation material 30 is not excessively impregnated, and the occurrence of dripping can be prevented.

As described above, according to the configuration adopted by the application container 1 of the present embodiment described above, the application container 1 includes the container main body 2 that accommodates the content liquid; the inner plug member 20 that has a cylindrical shape and is mounted on the mouth portion 10 of the container main body 2; and the impregnation material 30 that is fitted inside the inner plug member 20 and can be impregnated with the content liquid. The inner plug member 20 includes the impregnation material accommodating portion 21 that accommodates the impregnation material 30 in a state where the upper end portion 30*a* protrudes, and the valve body accommodating portion 22 which communicates with the impregnation material accommodating portion 21 and includes the valve seat 22*a* on the impregnation material accommodating portion 21 side and the valve body support portions 22*b* on the container main body 2 side, and in which the valve body 22*c* is disposed so as to be movable between the valve seat 22*a* and the valve body support portions 22*b*. The communication groove 50 which forms a gap between the valve body 22*c* and the valve body accommodating portion 22 in a state where the valve body 22*c* is supported by the valve body support portions 22*b*, and which allows the container main body 2 and the outside to communicate with each other via the valve body accommodating portion 22 and the impregnation material accommodating portion 21 is formed. As a result, an appropriate amount of the content liquid can be applied to the site to be applied, and the application container 1 having good ease of use can be obtained.

Second Embodiment

Next, a second embodiment of the present invention will be described. In the following description, the same reference signs are assigned to the same or equivalent configurations as those in the above-described embodiment, and descriptions thereof will be simplified or omitted.

Figure 3:
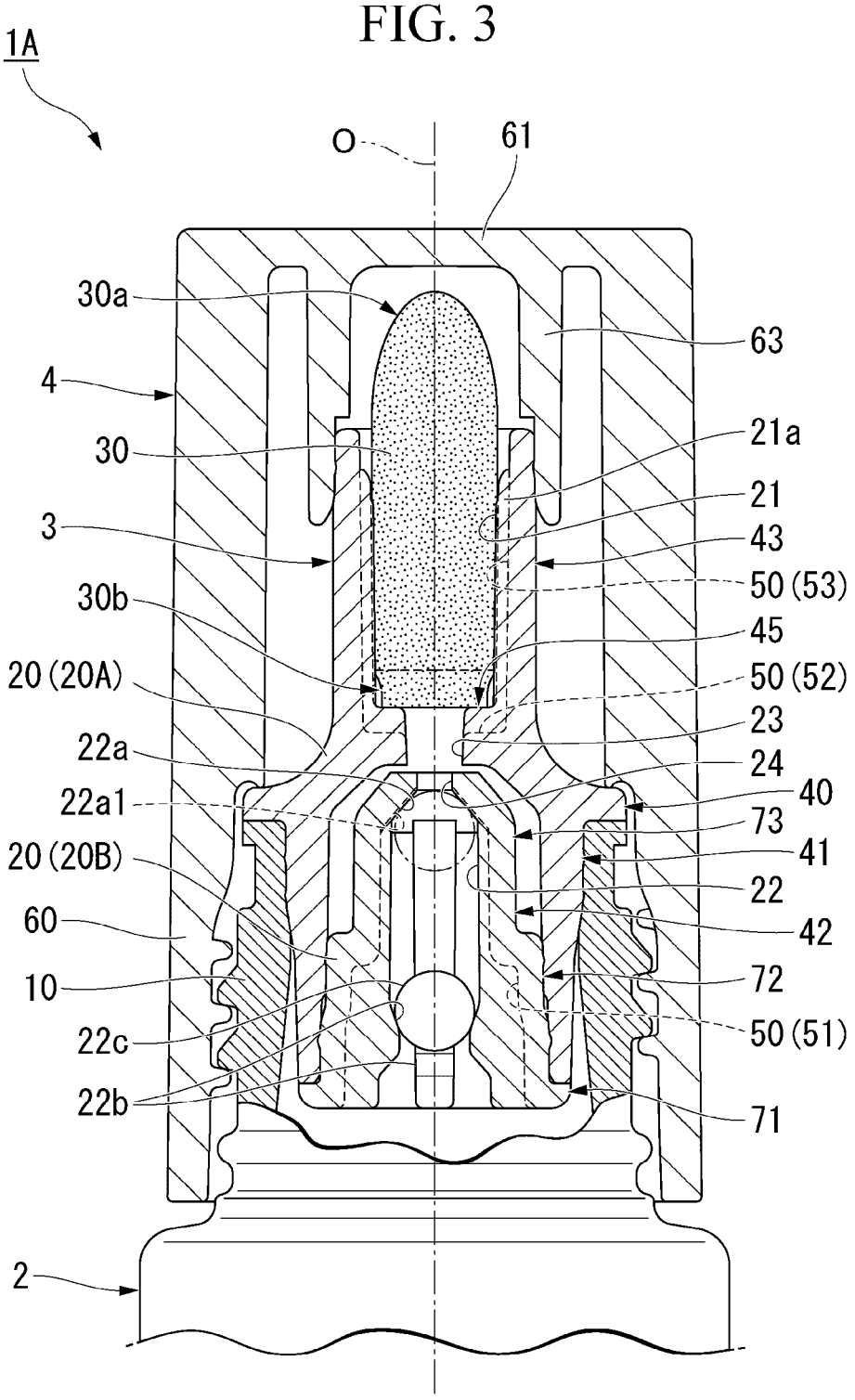
FIG. 3 is a longitudinal cross-sectional view of an application container according to a second embodiment of the present invention.

As shown in FIG. 3, an application container 1A of the second embodiment differs from the above embodiment in that the inner plug member 20 includes a first inner plug member 20A and a second inner plug member 20B.

The first inner plug member 20A forms the impregnation material accommodating portion 21. The impregnation material accommodating portion 21 of the second embodiment has a configuration where the fitting rib 21*a* and the support rib 45 described above are integrally formed and connected to each other. The first inner plug member 20A includes the flange portion 40, the fitting cylindrical portion 41, and the second cylindrical portion 43.

The second inner plug member 20B forms the valve body accommodating portion 22. The second inner plug member 20B corresponds to the first cylindrical portion 42 described above, and is a member separate from the first inner plug member 20A. The second inner plug member 20B is formed in a topped cylindrical shape of which a top wall is provided with a through-hole 24. The second inner plug member 20B and the through-hole 24 are disposed coaxially with the container axis O as a common axis.

The second inner plug member 20B includes a second flange portion 71 that is in contact with a lower end opening edge of the fitting cylindrical portion 41, a second fitting cylindrical portion 72 that is connected to a radial inner end edge of the second flange portion 71 and is fitted to an inner peripheral surface of a lower end portion of the fitting cylindrical portion 41, and a topped cylindrical portion 73 that is connected to an upper end portion of the second fitting cylindrical portion 72. The second flange portion 71 is formed in an annular shape that extends outward in the radial direction from a lower end opening edge of the second fitting cylindrical portion 72. The second fitting cylindrical portion 72 extends upward from the second flange portion 71, and an outer peripheral surface of the second fitting cylindrical portion 72 is undercut fitted to the inner peripheral surface of the fitting cylindrical portion 41.

The topped cylindrical portion 73 is further reduced in diameter than the second fitting cylindrical portion 72. Namely, the outer diameter of the topped cylindrical portion 73 is smaller than the outer diameter of the second fitting cylindrical portion 72. A step is formed between the topped cylindrical portion 73 and the second fitting cylindrical portion 72. The topped cylindrical portion 73 is disposed in non-contact with the fitting cylindrical portion 41 (first inner plug member 20A). The through-hole 24, the valve seat 22*a*, and the content liquid supply groove 22*a*1 described above are formed in the topped cylindrical portion 73. In addition, the valve body support portions 22*b* having a rib shape described above are formed from the topped cylindrical portion 73 to the second fitting cylindrical portion 72.

According to the application container 1A with the above configuration, when the overcap 4 is removed from the mouth portion 10 of the container main body 2, gas pressurized inside the container main body 2 enters the valve body accommodating portion 22 from a bottom portion opening of the second inner plug member 20B to pass through the first communication grooves 51 formed of the gaps between the valve body support portions 22*b* in the axial direction, and then the gas enters the impregnation material accommodating portion 21 via the through-hole 24 and the communication hole 23. After the gas which has entered the impregnation material accommodating portion 21 passes through the second communication grooves 52 formed of the gaps between the support ribs 45 in the radial direction, the gas passes through the third communication grooves 53 formed of the gaps between the fitting ribs 21*a* in the axial direction to escape from a top portion opening of the first inner plug member 20A to the outside. For this reason, when the overcap 4 is removed, at the same time, the pressure of the container main body 2 is released, so that there occurs no pressure difference between inside and outside the container main body 2. Therefore, according to the second embodiment, the same effects as those of the above-described embodiment can be obtained. In addition, the first inner plug member 20A and the second inner plug member 20B may be made of different materials.

Third Embodiment

Next, a third embodiment of the present invention will be described. In the following description, the same reference signs are assigned to the same or equivalent configurations as those in the above-described embodiment, and descriptions thereof will be simplified or omitted.

Figure 4:
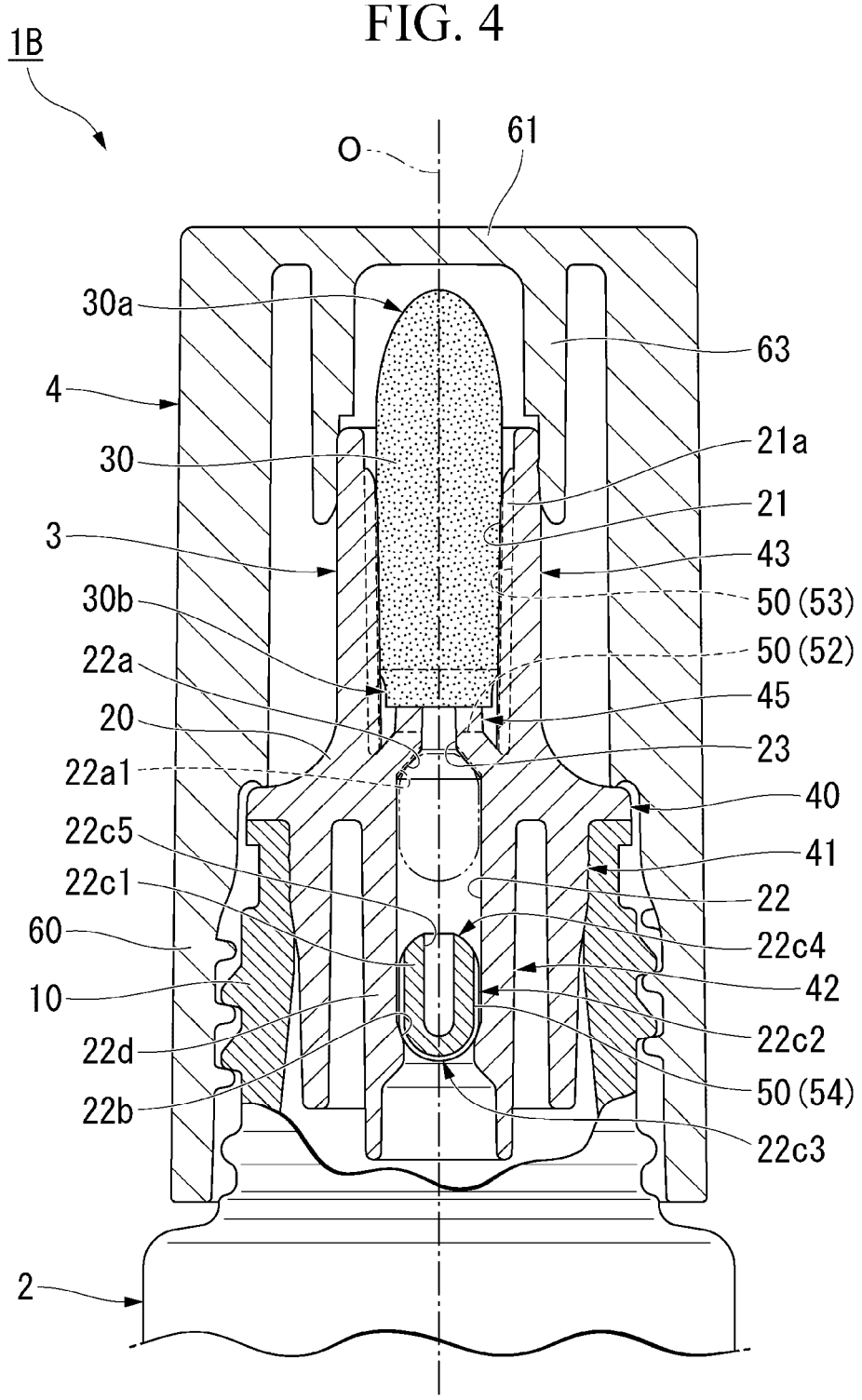
FIG. 4 is a longitudinal cross-sectional view of an application container according to a third embodiment of the present invention.

As shown in FIG. 4, an application container 1B of the third embodiment differs from the above embodiments in that the communication groove 50 is formed in a valve body 22*c*1.

The valve body 22*c*1 of the third embodiment is formed in a non-spherical shape. Specifically, the valve body 22*c*1 is a rotating body having the container axis O as a center, and is formed in a bale shape or a bullet shape. The valve body 22*c*1 has a guide surface 22*c*2 that has a cylindrical shape and is guided by a peripheral wall 22*d* of the valve body accommodating portion 22, and the communication groove 50 is formed in the guide surface 22*c*2. The communication groove 50 of the third embodiment includes the second communication groove 52 formed in the impregnation material accommodating portion 21 described above, the third communication groove 53 formed in the impregnation material accommodating portion 21 also described above, and a fourth communication groove 54 formed in the valve body 22*c*1 in the valve body accommodating portion 22.

The peripheral wall 22*d* of the valve body accommodating portion 22 extends in a cylindrical shape in the container axis O direction, and connects the valve seat 22*a* and the valve body support portions 22*b* described above. An inner wall surface of the peripheral wall 22*d* is a smooth peripheral surface, and a groove or the like extending the container axis O direction is not formed. The valve body support portions 22*b* of the third embodiment protrude in an annular shape inward in the radial direction from the inner wall surface of the peripheral wall 22*d*. Incidentally, similar to the above embodiments, grooves or the like extending in the container axis O direction may be formed in the valve body support portions 22*b*, and the valve body support portions 22*b* may have a rib shape.

The outer diameter of the guide surface 22*c*2 of the valve body 22*c*1 is slightly smaller than the inner diameter of the peripheral wall 22*d*. Accordingly, though the valve body 22*c*1 can rotate around the container axis O in the valve body accommodating portion 22, for example, rotation such as turning the valve body 22*c*1 upside down is not allowed, namely, the valve body 22*c*1 cannot rotate around an axis intersecting the container axis O. In other words, the valve body 22*c*1 can rotate around the container axis O in the valve body accommodating portion 22. However, the valve body 22*c*1 cannot rotate in the valve body accommodating portion 22 such that, for example, an upper portion and a lower portion of the valve body 22*c*1 are inverted, namely, the valve body 22*c*1 cannot rotate around the axis intersecting the container axis O. The fourth communication groove 54 is formed from the top to the bottom of the guide surface 22*c*2 having a cylindrical shape, and is formed up to a lower end surface 22*c*3 that has a lower hemispherical shape and is connected to a lower end of the guide surface 22*c*2.

Figure 5:
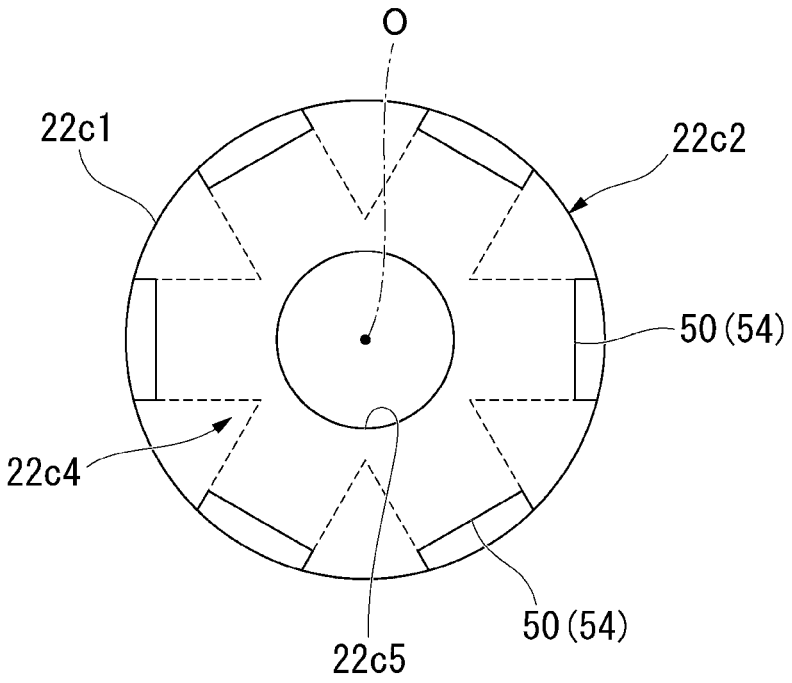
FIG. 5 is a plan view of a valve body according to the third embodiment of the present invention.

As shown in a plan view of the valve body 22*c*1 of FIG. 5, a plurality of (six in the present embodiment) the fourth communication grooves 54 are formed in the guide surface 22*c*2 of the valve body 22*c*1 at intervals in the circumferential direction. The six fourth communication grooves 54 merge with each other at the center (container axis O) of the lower end surface 22*c*3. Incidentally, all of the six fourth communication grooves 54 do not necessarily merge with each other at the center of the lower end surface 22*c*3, and at least one set of the fourth communication grooves 54 which are disposed point-symmetrically with respect to the container axis O in the radial direction may merge with each other.

Returning to FIG. 4, a bottomed hole 22*c*5 extending in the container axis O direction is formed in an upper end surface 22*c*4 that has an upper hemispherical shape and is connected to an upper end of the guide surface 22*c*2. The bottomed hole 22*c*5 is formed at the center of the valve body 22*c*1. Specifically, the bottomed hole 22*c*5 is formed at the center in the radial direction of the valve body 22*c*1. In addition, for example, when the valve body 22*c*1 is resin molded, the bottomed hole 22*c*5 is a lightening hole. In addition, when the valve body 22*c*1 is inserted from a lower end of the valve body accommodating portion 22, the bottomed hole 22*c*5 forms a space which enables the valve body 22*c*1 to be deformed, such as a reduction in diameter, to allow the valve body 22*c*1 to pass through the valve body support portions 22*b*. Namely, when the valve body 22*c*1 passes through the valve body support portions 22*b*, the valve body 22*c*1 is elastically deformed so as to be temporarily reduced in diameter by the valve body support portions 22*b*, in other words, the space formed by the bottomed hole 22*c*5 is temporarily reduced inward in the radial direction. In addition, the diameter of the bottomed hole 22*c*5 is smaller than the diameter of the communication hole 23. Accordingly, the upper end surface 22*c*4 of the valve body 22*c*1 can come into close contact with the valve seat 22*a* entirely in the circumferential direction.

According to the application container 1B with the above configuration, when the container main body 2 is in an upright state, the valve body 22*c* is supported by the valve body support portions 22*b*, and the container main body 2 and the outside communicate with each other through the communication groove 50. Namely, gas pressurized inside the container main body 2 enters the valve body accommodating portion 22 from the bottom portion opening of the first cylindrical portion 42 to pass through a gap between the valve body 22*c*1 and the peripheral wall 22*d* in the axial direction via the fourth communication grooves 54 formed in the valve body 22*c*1, and then to enter the impregnation material accommodating portion 21 via the communication hole 23. After the gas which has entered the impregnation material accommodating portion 21 passes through the second communication grooves 52 formed of the gaps between the support ribs 45 in the radial direction, the gas passes through the third communication grooves 53 formed of the gaps between the fitting ribs 21*a* in the axial direction to escape from the top portion opening of the second cylindrical portion 43 to the outside. For this reason, the pressure of the container main body 2 is released, so that there occurs no pressure difference between the inside and outside of the container main body 2.

Here, the valve body 22*c*1 is formed in a non-spherical shape and has the guide surface 22*c*2 that is guided by the peripheral wall 22*d* of the valve body accommodating portion 22, and the fourth communication grooves 54 are formed in the guide surface 22*c*2 of the valve body 22*c*1. For this reason, for example, when the container main body 2 is brought into an inverted state and then the application container 1B is to be used, even when the valve body 22*c*1 moves upward and downward, the valve body 22*c*1 rotates around the container axis O in the valve body accommodating portion 22, but rotation such as turning the valve body 22*c*1 upside down, namely, the rotation around the axis intersecting the container axis O is not allowed. For this reason, the posture of the valve body 22*c*1 is maintained in a certain posture, and the pressure of the container main body 2 can be reliably released via the fourth communication grooves 54 formed in the valve body 22*c*1.

In addition, the substitution of the components in the above embodiments with well-known components can be appropriately made without departing from the concept of the present invention.

For example, though the above embodiments have described the configuration where the valve body moves in the valve body accommodating portion due to the own weight of the valve body, the present invention is not limited to the configuration. For example, the valve body may be configured to move in the valve body accommodating portion due to pressurization by squeeze deformation of the container main body.

In addition, for example, though the first and second embodiments have described the configuration where the valve body is a sphere, and the third embodiment has described the configuration where the valve body is a rotating body (bale shape or bullet shape) having the container axis as a center, the present invention is not limited to the configurations. For example, the valve body may be configured to have a columnar shape. Namely, the shape of the valve body is not limited as long as the valve body can move in the valve body accommodating portion.

In addition, the present invention is not limited to a configuration where the communication groove is formed in only one of the valve body accommodating portion and the valve body. For example, the communication grooves may be formed in both of the valve body accommodating portion and the valve body by a combination of the configurations of the first and second embodiments and the configuration of the third embodiment.

INDUSTRIAL APPLICABILITY

According to the present invention, an appropriate amount of the content liquid can be applied to a site to be applied, and the application container having good ease of use can be obtained.

REFERENCE SIGNS LIST

1 Application container
1A Application container
1B Application container
2 Container main body
3 Application plug
4 Overcap
10 Mouth portion
20 Inner plug member
20A First inner plug member
20B Second inner plug member
21 Impregnation material accommodating portion
21*a* Fitting rib
22 Valve body accommodating portion
22*a* Valve seat
22*a*1 Content liquid supply groove
22*b* Valve body support portion
22*c* Valve body
22*c*1 Valve body
22*c*2 Guide surface
22*c*3 Lower end surface
22*c*4 Upper end surface
22*c*5 Bottomed hole
22*d* Peripheral wall
23 Communication hole
24 through-hole
30 Impregnation material
30*a* Upper end portion (tip portion)
30*b* Lower end portion
40 Flange portion
41 Fitting cylindrical portion
42 First cylindrical portion
43 Second cylindrical portion
45 Support rib
50 Communication groove
51 First communication groove
52 Second communication groove

53 Third communication groove
54 Fourth communication groove
60 Cap cylinder
61 Cap top wall
63 Support cylindrical portion
71 Second flange portion
72 Second fitting cylindrical portion
73 Topped cylindrical portion
O Container axis

The invention claimed is:

1. An application container comprising:

a container main body that accommodates a content liquid;

an inner plug member that has a cylindrical shape and is mounted on a mouth portion of the container main body; and an impregnation material that is fitted inside the inner plug member and is impregnable with the content liquid, wherein the inner plug member includes:

an impregnation material accommodating portion that accommodates the impregnation material in a state where a tip portion of the impregnation material protrudes; and a valve body accommodating portion which communicates with the impregnation material accommodating portion and includes a valve seat on an impregnation material accommodating portion side and a valve body support portion on a container main body side, and in which a valve body is disposed so as to be movable between the valve seat and the valve body support portion, and a communication groove which forms a gap between the valve body and the valve body accommodating portion in a state where the valve body is supported by the valve body support portion, and which allows the container main body and an outside to communicate with each other via the valve body accommodating portion and the impregnation material accommodating portion is formed.

2. The application container according to claim 1, wherein the valve seat is provided with a content liquid supply groove that supplies the content liquid from the valve body accommodating portion to the impregnation material in a state where the valve seat is in contact with the valve body.

3. The application container according to claim 1 or 2, wherein the valve body accommodating portion has a peripheral wall that connects the valve seat and the valve body support portion, the valve body is formed in a non-spherical shape, and has a guide surface that is guided by the peripheral wall of the valve body accommodating portion, and the communication groove is formed in the guide surface of the valve body.

* * * * *